US007640697B2

(12) United States Patent
Florentin et al.

(10) Patent No.: US 7,640,697 B2
(45) Date of Patent: Jan. 5, 2010

(54) DEVICE FOR CONNECTING THE FIXING REGION OF A GUIDE RAIL TO THE DOOR BODY OF A VEHICLE DOOR

(75) Inventors: Thierry Florentin, Coburg (DE); Dalibor Rietdijk, Wetzlar (DE)

(73) Assignee: Brose Fahrzeugteile GmbH & Co. KG, Coburg, Coburg (DE)

( * ) Notice: Subject to any disclaimer, the term of this patent is extended or adjusted under 35 U.S.C. 154(b) by 613 days.

(21) Appl. No.: 10/533,366

(22) PCT Filed: Oct. 29, 2003

(86) PCT No.: PCT/DE03/03674

§ 371 (c)(1),
(2), (4) Date: May 24, 2006

(87) PCT Pub. No.: WO2004/039617

PCT Pub. Date: May 13, 2004

(65) Prior Publication Data

US 2006/0254146 A1 Nov. 16, 2006

(30) Foreign Application Priority Data

Oct. 30, 2002 (DE) ..... 102 50 998
Dec. 6, 2002 (DE) ..... 202 19 264 U

(51) Int. Cl.
*E05F 15/16* (2006.01)

(52) U.S. Cl. ..... 49/348; 49/502

(58) Field of Classification Search ..... 49/212, 49/348, 349, 352, 502; 296/146.5, 146.7; 403/110

See application file for complete search history.

(56) References Cited

U.S. PATENT DOCUMENTS 4,586,290 A * 5/1986 Juechter ..... 49/348

(Continued)

FOREIGN PATENT DOCUMENTS

DE 35 27 783 2/1987

(Continued)

OTHER PUBLICATIONS

International Search Report of PCT/DE2003/03674, dated Jan. 19, 2005.

*Primary Examiner*—Katherine W Mitchell
*Assistant Examiner*—Michael J Keller
(74) *Attorney, Agent, or Firm*—Christie, Parker & Hale, LLP

(57) ABSTRACT

A guide piece, for connecting the fixing region of a guide rail to the door frame of a vehicle door, whereby the guide piece may be fixed in the external skin thereof, houses a fixing means and the fixing region of the guide rail which may be adjusted in the direction of the vehicle transverse axis (Y-axis) within the guide piece. The guide piece with fixing clips in slots in the external skin can be adjusted in the direction of the vehicle longitudinal axis (X-axis) as required, relative to the external skin of the door frame and may be pre-positioned on the fixing region of the guide rail with a positive fit. The guide piece is embodied in two pieces and comprises a cover which may be connected to a baseplate, between which a part of the fixing means is positively fitted and a part of the fixing region of the guide rail is adjustably arranged perpendicular to the plane of the vehicle door (Y-axis).

6 Claims, 12 Drawing Sheets

U.S. PATENT DOCUMENTS

| | | | | |
|---|---|---|---|---|
| 4,660,885 | A | 4/1987 | Suhr et al. | |
| 4,956,942 | A * | 9/1990 | Lisak et al. | 49/502 |
| 4,981,321 | A | 1/1991 | Watanabe et al. | |
| 5,338,064 | A * | 8/1994 | Sadakata et al. | 280/775 |
| 5,469,668 | A | 11/1995 | Heim et al. | |
| 5,632,121 | A * | 5/1997 | Handte et al. | 49/502 |
| 5,673,515 | A | 10/1997 | Weber et al. | |
| 5,743,150 | A * | 4/1998 | Fevre et al. | 74/493 |
| 5,927,021 | A * | 7/1999 | Kowalski et al. | 49/502 |
| 5,960,588 | A * | 10/1999 | Wurm et al. | 49/352 |
| 6,041,549 | A | 3/2000 | Schust et al. | |
| 6,092,957 | A * | 7/2000 | Fevre et al. | 403/373 |
| 6,425,208 | B1 * | 7/2002 | Klueger et al. | 49/502 |
| 6,560,930 | B2 | 5/2003 | de Gaillard | |
| 6,807,773 | B2 * | 10/2004 | Cardine et al. | 49/212 |
| 6,952,898 | B2 * | 10/2005 | Castellon | 49/349 |
| 2001/0020347 | A1 | 9/2001 | de Gaillard | |
| 2007/0214726 | A1 * | 9/2007 | Graf et al. | 49/352 |

FOREIGN PATENT DOCUMENTS

| | | | |
|---|---|---|---|
| DE | 35 27 783 | A1 | 2/1987 |
| DE | 44 35 008 | | 4/1996 |
| DE | 44 35 008 | A1 | 4/1996 |
| DE | 44 35 088 | | 4/1996 |
| DE | 195 21 121 | | 12/1996 |
| DE | 195 21 121 | A1 | 12/1996 |
| DE | 196 11 074 | | 9/1997 |
| DE | 196 11 074 | A1 | 9/1997 |
| DE | 199 61 354 | | 7/2001 |
| DE | 199 61 354 | A1 | 7/2001 |
| DE | 100 14 946 | | 9/2001 |
| DE | 100 14 946 | A1 | 9/2001 |
| DE | 100 44 845 | | 4/2002 |
| DE | 100 44 845 | A1 | 4/2002 |
| DE | 101 38 586 | | 3/2003 |
| DE | 102 04 610 | | 8/2003 |
| DE | 102 04 610 | A1 | 8/2003 |
| EP | 0 356 373 | | 2/1990 |
| EP | 0 356 373 | A1 | 2/1990 |
| EP | 0 613 797 | | 9/1994 |
| EP | 0 613 797 | A2 | 9/1994 |
| EP | 0 626 283 | | 11/1994 |
| EP | 0 626 283 | A1 | 11/1994 |
| EP | 0 704 597 | | 4/1996 |
| WO | WO 98/16709 | | 4/1998 |

* cited by examiner

DEVICE FOR CONNECTING THE FIXING REGION OF A GUIDE RAIL TO THE DOOR BODY OF A VEHICLE DOOR

CROSS-REFERENCE TO A RELATED APPLICATION

This application is a National Phase Patent Application of International Application Number PCT/DE2003/003674, filed on Oct. 29, 2003, which claims priority of German Patent Application Number 102 50 998.0, filed on Oct. 30, 2002 and of German Utility Model Number 202 19 264.4, filed on Dec. 6, 2002.

BACKGROUND

The invention relates to a device for connecting the fixing region of a guide rail to the door body of a vehicle door.

From the German Patent Application No. 196 11 074 A1 a frameless vehicle door is known having a cable window lifter which can be adjusted transversely to the plane of the window pane and whose guide rails are connected by their upper fixing region to the door body wherein this region is designed sufficiently elastic so that the adjusting region can be readily compensated by a few angular degrees. The lower fixing region of the guide rail is provided with an adjusting and fixing angle which has an oblong hole which defines the adjusting region of the guide rail transversely to the plane of the window pane. Once it has been adjusted the position of the guide rail is fixed by means of a screw connection. The holding angle is thereby drawn firmly against the door body.

In the event however that a gap exists between the fixing angle of the guide rail and the associated fixing point on the side of the door body the curved guide rail is correspondingly stretched so that the pull-down radius for the window pane is increased. On the other hand if the fixing angle under tension stands out on the fixing point on the door body side this then results in a more marked curvature of the guide rail which reduces the pull-down radius. In both cases unacceptable changes to the running of the window pane occur which leads in particular to increased friction during movement.

The disadvantages described can indeed be overcome by avoiding the manufacturing and assembly tolerances but this considerably increases the production costs.

From the European Patent Application No. 0 626 283 A1 a vehicle door is known having a door body in which at least a guide rail is mounted which is connected at one end to a fixing angle and is held in position on the door body. The fixing angle interacts with a retaining block fixed on the door body and with a securing plate which holds a foot section of the fixing angle above secured against rotation and is guided displaceable in the longitudinal direction of the vehicle on a support face of the retaining block underneath. Two longitudinally extending downwardly aligned guide webs are provided on the securing plate spaced from each other to interact with lateral edge sections of the contact bearing face of the retaining block and fix the securing plate in the transverse direction of the door body.

Adjusting and fixing the guide rail in the X and Y directions is carried out by means of a nut provided on the foot section of the fixing angle and in which the fixing screw can be turned from below whereby recesses on the retaining block and the securing plate are made substantially larger than the outer diameter of the fixing screw. The movably mounted fixing screw is however difficult to find from the outside surface area of the door body since it is disposed in an area which cannot be seen. Furthermore it is necessary to provide a retaining block in the door body which increases the assembly costs and requires further tolerances to be taken into consideration.

From the U.S. Pat. No. 4,965,942 a window lifter is known whose guide rail is able to pivot about a rotational axis mounted in the region of the door sill and is adjustable in the direction of the vehicle transverse axis or Y-axis by means of an adjusting device which is mounted in the region of the door body and is accessible from outside of the door body so that the fully extended window pane adjoins flush against an upper door or body seal. With the adjusting device known from the International Patent Application Publication number 98/16709 the adjustment in the direction of the Y-axis is additionally restricted by an oblong hole which runs transversely to the plane of the window pane.

An adjusting device known from the German Patent Application No. 44 35 008 A1 has a guide rail of the window lifter assembly running inside the door body and able to pivot about an upper rotational point in the transverse direction of the vehicle where it can be locked by means of the adjusting device engaging in the lower region of the guide rail in such a position that the edge region of the door window pane bears against an adjoining sealing body under pretension. In order to adjust the door window pane without dismantling the door inside trim the guide rail can be moved by its lower end in a transverse direction to the door window pane in a displacement guide and can be fixed by means of fixing elements which are accessible from the underneath side of the door body.

The object of the present invention is to provide a device of the kind mentioned at the beginning which guarantees a simple tension-free fitting of the guide rail in the door body of a vehicle door even taking into consideration large tolerances with the adjustment accessible from outside of the door body and fixing of the guide rail, which enables universal use for different models of vehicles and which requires no additional parts which have to be permanently connected to the door body of a vehicle door.

This is achieved in a first variation according to the invention through a guide part which can be inserted in the external surface area of the door body, can be connected to the latter and holds the fixing means and the fixing region of the guide rail.

This first variation of the solution ensures a simple fitting of the guide rail in the door body of a vehicle door with an adjustment and fixing of the guide rail accessible from outside of the door body without additional parts which are to be permanently connected to the door body of a vehicle door, a tension-free fitting of the guide rail even when taking into consideration great tolerances and universal use for different vehicle models.

This first variation enables a pre-fitting of the fixing region of the guide rail with a guide part which serves for the connection between the guide rail and the door body of the vehicle door and thus enables the provision of an assembly unit which enables a quick and easy fitting at the site of the connection of the guide rail to the door body of a vehicle door. This connection of the fixing region of the guide rail to the outer surface area of the door body provides the pre-requirement and basis for a self-adjustment of the guide rail without torsion or tensioning forces acting on the guide rail and thus a tension-free connection of the guide rail to the door body of the vehicle door. This tension-free connection is also obtained during actuation of the fixing means to fix the guide rail on the door body since the guide part is intended and designed to divert the tensioning forces and any torque which may arise directly into the door body without the guide rail thereby becoming strained.

In order that the guide rail can be adjusted in the Y-direction of the vehicle the fixing region of the guide rail can be displaced in the direction of the vehicle transverse axis (Y-axis) inside the guide part.

Where necessary and depending on the useful site of the guide part the guide part can be displaced in the direction of the vehicle longitudinal axis (X-axis) opposite the outer surface area of the door body and thus can enable a compensation in the direction of the X-axis or form a fixed stop in the X-direction whereby the guide part can be pre-positioned, preferably with positive engagement, on the fixing region of the guide rail and holds at least a part of the fixing means with positive locking engagement so that a simple assembly is possible during manufacture of the pre-assembly unit of guide rail and guide part which enables a suitable pre-adjustment or a basic adjustment such that a sufficient tolerance compensation is guaranteed both in the direction of the X-axis and in the direction of the Y-axis.

The in particular positive-locking hold of at least a part of the fixing means ensures that the fixing means for fixing the guide rail on the door body of a vehicle door are arranged secured against rotation and secured against loss. The need for welding a fixing means onto the fixing region of a guide rail or onto the door body no longer applies.

The guide part which is formed as a moulded plastics part in the manner of a cassette is preferably in two parts and has a cover which can be connected to a base plate which are connected together through a hinge, preferably a film hinge, and between which a part of the fixing means is mounted with positive locking engagement and a part of the fixing region of the guide rail is mounted adjustable perpendicular to the plane of the vehicle door (Y-axis).

Through the two-part design of the guide part with a cover connected to a base plate through a hinge, preferably through a film hinge, between which a part of the fixing means is mounted with positive locking engagement and a part of the fixing region of the guide rail is mounted displaceable perpendicular to the plane of the vehicle door (Y-axis) the guide part adopts the form of a cassette which guides the guide rail over its adjusting path so that the guide can be set up exactly relative to the rotational point of the rail. The design of the guide part as a moulded plastics part enables a simple manufacture for example through injection moulding and a simple pre- and final assembly since the fixing means and the fixing region of the guide rail have only to be inserted into the opened guide part and the guide part to be closed by connecting the cover to the base plate so that it can be prefitted in this state on the fixing region of the guide rail and supplied as such for final assembly in a vehicle door.

In a preferred embodiment the guide part has a convex stop directed to a side edge of the fixing region of the guide rail.

The arrangement of a convex stop on the guide part enables the fixing region of the guide rail to automatically assume a position in which no torque acts on the guide rail, i.e. no twisting of the guide rail can take place.

The connection between the base plate and cover of the guide part preferably takes place through positive locking and connecting elements whereby a positive locking element protrudes from a raised surface of the cover and when the guide part is closed engages in an opening in the base plate matching the cross-sectional shape of the positive locking element whilst a connecting element has a closing clip protruding towards the inside of the cover to engage when the guide part is closed in a closing opening of the base plate of the guide part to connect the cover and base plate.

In order to be able to position the guide rail in a nominal position without aids the guide part has a pre-adjusting element which can be positively connected to the fixing region of the guide rail and which consists of a detent element which is connected to the cover or to the base plate of the guide part and which is connected with positive engagement to a counter detent element of the fixing region of the guide rail. The special configuration of the pre-adjusting element ensures easy release of the connection between the guide part and the fixing region of the guide rail.

In order to connect the guide part to the outer surface area of the door body fixing clips protrude from the base plate of the guide part to engage in slots which run parallel to the X-axis and have a length corresponding to the adjustment in the direction of the X-axis.

The fixing clips enable positioning and temporary fixing of the guide part on the outer surface area of the door body and thus ensure an anti-rotational lock of the guide rail when torque is exerted on the fixing means since torque is introduced directly through the guide part and fixing clips into the door body thereby preventing twisting of the guide rail.

Furthermore the length of the slots provided in the outer surface area to receive the fixing clips can be varied and thus either cause the guide part to be fixed in the direction of the X-axis or enable a compensation in the X-direction.

More particularly the fixing means can consist of a fixing screw connected to the guide part and of a fixing nut which can be screwed onto the thread of the fixing screw from outside of the outer surface area of the door body, whereby the head of the fixing screw is inserted with positive locking engagement into a screw head socket of the cover of the guide part.

The guide part thus supports the fixing screw secured against loss in the preassembled position and ensures an anti-rotational lock of the fixing screw when the fixing means is tightened for example by screwing a fixing nut onto the fixing screw, without the fixing screw having to be secured in some other way, for example by welding on the screw head. This enables a simple insertion of the fixing screw in the guide part without additional fixing measures.

For an easy adjustment of the guide rail an adjusting lever is provided which protrudes from the fixing region of the guide rail, engages through an opening provided in the outer surface area of the door body and can be operated from outside the door body.

The guide rail or the fixing region of the guide rail or a fixing element connected to the guide rail together with the guide part with the fixing means inserted therein preferably form one pre-assembled unit which can be supplied to the assembly site and inserted there into a vehicle door and then connected easily to the door body.

In a second variation the problem underlying the invention is solved according to the invention through a guide part which is prefitted on the fixing region of the guide rail and is connectable to the door body and receives a first part of the multi-part fixing means, through a device for aligning the fixing region of the guide rail relative to the guide part and to the door body at least in the direction of the vehicle transverse axis (Y-axis), and a second part of the fixing means for producing a clamping connection between the fixing region of the guide rail and the door body.

This variation also ensures a simple tension-free assembly of the guide rail in the door body of a vehicle door even taking into account greater tolerances with an adjustment and fixing of the guide rail which is accessible from outside the door body and is both reproducible and variable in the transverse direction of the vehicle, enables a universal use for different models of vehicles and requires no additional parts which have to be permanently connected to the door body of a vehicle door.

Through the ability to pre-fit the guide part on the fixing region of the guide rail the guide part can be attached secured against loss together with a part of the fixing means to the guide rail and can thus be supplied together with the window lifter as one unit to the assembly site. During assembly the guide part which is prefitted on the fixing region of the guide rail serves both as an adjusting gauge and positioning aid as well as for holding of a part of the fixing means secured against loss so that the adjusting of the guide rail can be changed and reproduced at any time in the transverse direction of the vehicle to ensure an exact lowering of the window pane, and the fixing means which can be inserted through the door body and thus through a region which is not directly in the line of sight ensures an easy and secure fitting.

Since the guide part which is prefitted on the fixing region of the guide rail can be connected to the door body the connecting forces which arise during connection between the fixing region of the guide rail and the door body are not transferred to the guide rail but are introduced directly into the door body and thus into the vehicle door and thus produce a secure clamp-fit connection between the guide rail and the door body after the guide rail has been aligned in the transverse direction of the vehicle.

For further simplification of the manufacture and assembly of the guide part the guide part is formed in one piece and is connected on the side of the fixing region of the guide rail remote from the door body to the fixing region of the guide rail with positive locking engagement.

The one-piece design of the guide part requires that the guide part can be made from any material, preferably however from plastics, and needs no connecting elements for example in the form of film hinges or the like as in the case of a multi-part guide part. Thus there is also a greater freedom in design so that the guide part can be provided where required with a glass fibre reinforcement.

The positive locking connection between the guide part and the fixing region of the guide rail on the side of the fixing region of the guide rail remote from the door body ensures that the clamping faces of the fixing region and the door body rest on each other directly and thus in particular without any intermediate adhesive layer on the guide part, and are thus connected together with force-locking engagement. The one-piece design of the guide part and its positive locking connection with the fixing region of the guide rail in fact enables the guide part to be manufactured for different shapes and thicknesses of guide rails and their fixing regions since the positive locking hold can be provided with a larger play because this play does not have any effect on the connection of the guide rail to the door body of the vehicle door.

An advantageous development of the solution according to the invention is characterised in that a part of the fixing means is pushed through a slot opening in the fixing region of the guide rail running in the direction of the vehicle transverse axis or Y-axis of the vehicle.

The slot opening provided in the fixing region enables in simple manner adjustment of the guide rail in the vehicle transverse direction or Y-direction of the vehicle whereby the pre-positioning of the guide part on the fixing region of the guide rail and its connection to the door body enables easy insertion of the fixing means. The part of the multi-part fixing means mounted secured against loss in the guide part can thereby be pushed through the slot opening of the fixing region and through a corresponding opening in the door body or can be pushed from outside the door body through the opening in the door body and the slot opening in the fixing region of the guide rail and connected to the part of the multi-part fixing means mounted in the guide part.

The fixing region of the guide rail preferably has a contact bearing face and edge zones angled from the contact bearing face and running parallel to the slot opening in order to engage round the clip-like studs of the guide part which can be inserted in positioning openings in the door body.

The edge zones of the fixing region of the guide rail which are angled from the contact bearing face and run parallel to the slot opening enable simple displacement of the fixing region relative to the guide part and thus an easy alignment of the guide rail for a tension-free lowering of the window pane. The clip-like studs of the guide part which can be inserted in positioning openings of the door body and engage round the angled edge zones ensure on the one hand the positive locking connection between the guide part and fixing region of the guide rail and on the other hand a positive locking connection between the guide part and the door body of the vehicle door before aligning the guide rail with subsequent force-locking connection of the fixing region of the guide rail with the door body of the vehicle door. The clip-like studs of the guide part which engage with positive locking connection in the door openings of the door body ensure an anti-rotational lock of the guide part during actuation of the fixing means for the force-locking connection of the fixing region of the guide rail with the door body of the vehicle door as well as for the pre-positioning and pre-fixing of the guide rail on the door body of the vehicle door.

With a double-strand window lifter an automatic X-compensation in the assembly phase is guaranteed. The clip-like studs of the guide part connected to the one guide rail thereby engage with positive locking connection in the positioning openings of the door body whilst the clip-like studs of the guide part connected to the other guide rail of the double-strand cable window lifter engage with play in the positioning openings of the door body which widen out at least in the X-direction so that an automatic tolerance compensation in the vehicle longitudinal direction or X-direction is guaranteed in conjunction with a slot opening in the fixing region of the guide rail which is wider than the part of the fixing means inserted through the slot opening.

To simplify the adjustment of the guide rail in the Y-direction of the vehicle after pre-assembly of the guide part on the door body, an angled edge zone of the fixing region of the guide rail has positive locking elements which can be brought into engagement with counter positive locking elements of a tool which can be inserted into a pot-shaped opening of the clip-like stud of the guide part associated with the relevant edge zone, this opening being open to the door body for guiding the tool.

The adjustment of the guide rail relative to the door body of the vehicle door can thus be undertaken from outside of the door body whereby the pot-shaped opening in the one clip-like side profile of the guide part ensures a secure guide of the tool which is designed for example as a Torx screw driver. Since the opening provided in the door body aligns with the pot-shaped opening of the one clip-shaped side profile of the guide part which (opening) opens towards the door body, the number of apertures required in the vehicle door is also reduced. By turning the tool and connecting the positive locking elements in the angled edge zone of the fixing region of the guide rail with the counter positive locking elements of the tool an easy and secure adjustment of the guide rail is ensured.

In addition in the other clip-shaped side profile of the guide part there is a contact bearing bead which adjoins the outer edge of the angled edge zone of the fixing region of the guide rail whereby during adjustment of the guide rail in the Y-direction of the vehicle the fixing region of the guide rail is able to tilt about the contact bearing bead so that on the one hand a corresponding movement compensation of the guide rail is ensured and on the other hand the play between the positive locking elements on the angled edge zone of the fixing region of the guide rail and the counter positive locking elements of the tool is reduced. At the same time it is ensured that the rotational forces during actuation of the fixing means do not flow over the guide rails which unlike the prior art need not therefore be secured against rotation.

A further advantageous development of the solution according to the invention is characterised by a detent catch connection which engages in a nominal position of the guide part relative to the fixing region of the guide rail so that the guide rail can be positioned in this nominal position without any other aids.

The detent connection consists of an opening provided in an angled edge zone of the fixing region of the guide rail and of a detent catch engaging in the opening and consisting in particular of a ball head which engages in the opening of the fixing region of the guide rail. This detent connection can according to a further feature be released and engaged again for the purposes of adjustment on the vehicle.

The adjusting path through the slot opening in the fixing region of the guide rail as well as the detent opening for the nominal adjustment are defined on the guide rail and not on the guide part so that the guide part is not specific to the vehicle but can therefore be used for different vehicle models.

The fixing means preferably consists of the connection of a fixing screw with a fixing nut whereby the guide part holds the fixing screw or fixing nut secured both in the rotational direction and in the axial direction.

The hold of a part of the fixing means secured against loss in the guide part is thus guaranteed and a counter bearing when tightening the fixing means ensures the force locking connection between the fixing region of the guide rail and the door body of the vehicle door.

BRIEF DESCRIPTION OF THE DRAWINGS

The invention will now be described in further detail with reference to an embodiment illustrated in the drawings.

Figure 2:
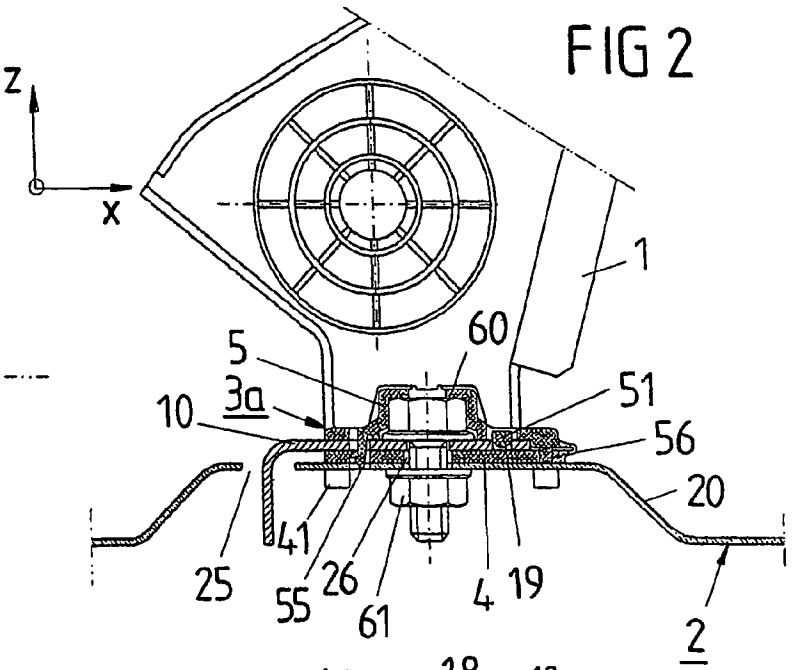
FIG. 2 is a longitudinal sectional view of a first variation for connecting the fixing region of a guide rail to a door body or vehicle door through a guide part.
Figure 3:
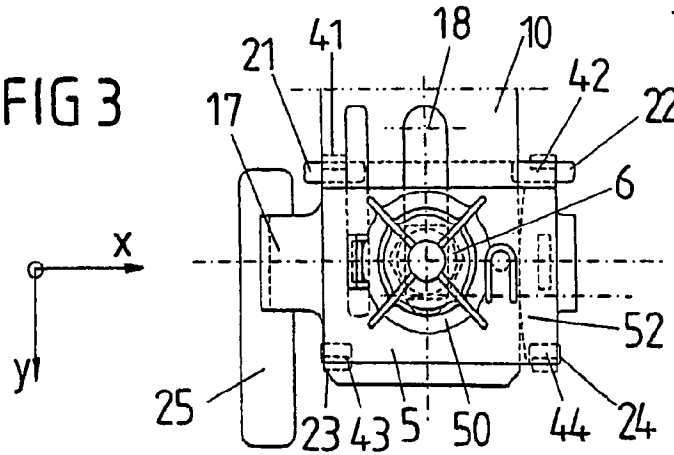
FIG. 3 is a plan view of a first variation for connecting the fixing region of a guide rail to a door body or vehicle door through a guide part.
Figure 1:
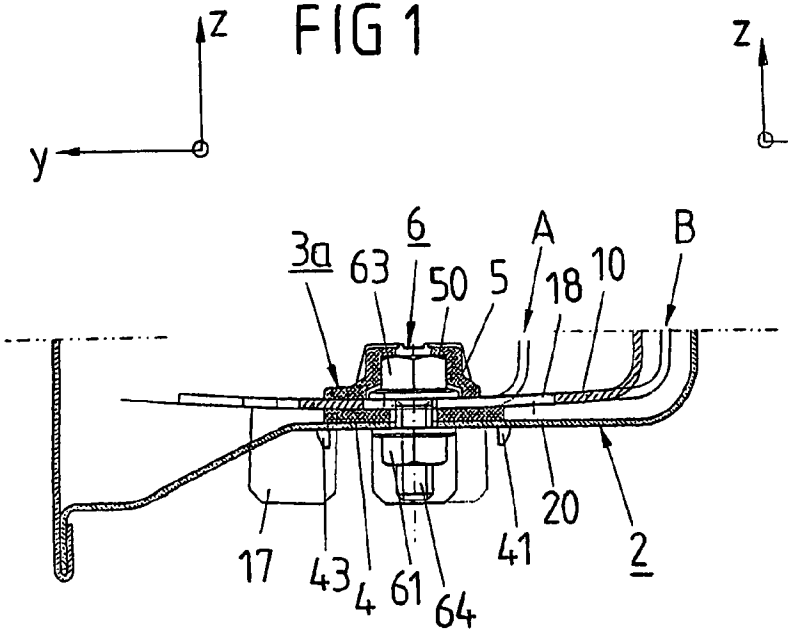
FIG. 1 is a cross-sectional view of a first variation for connecting the fixing region of a guide rail to a door body or vehicle door through a guide part.

The connecting region between the fixing region 10 of a guide rail 1 and an outer surface area 20, by way of example a door sill or door body, of a door body 2, is shown in different views partly in section in FIGS. 1 to 3 which each show additionally the alignment of the parts which are to be connected by means of a guide part 3*a* producing the connection in relation to the axes of a vehicle of which the X-axis corresponds to the vehicle longitudinal direction, the Y-axis to the vehicle transverse direction and the Z-axis to the vehicle vertical axis.

FIG. 1 shows a cross-section through the connecting region with a door body 20 of a door body 2 designed as a door inside panel and on which the fixing region 10 of a guide rail 1 is fixed, but is connected to the door body 20 displaceable in the Y-direction. The positions A and B show the different end positions of the fixing region 10 of the guide rail 1 which consists of a fixing angle connected to the guide rail or of an angled end of the guide rail 1.

Figure 4:
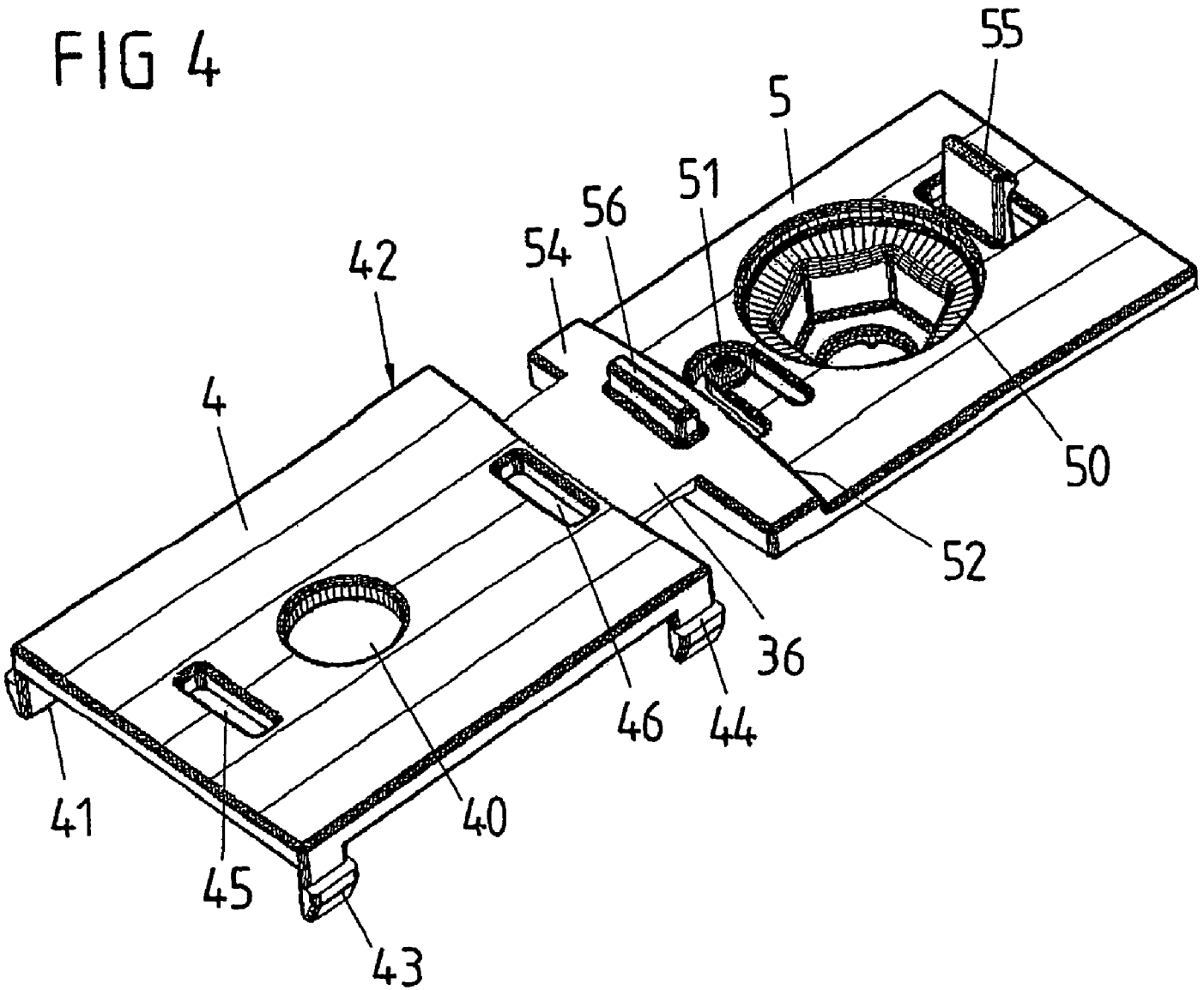
FIG. 4 is a perspective view of the guide part which consists of a cover and base plate according to FIGS. 1 to 3 in the opened state.
Figure 5:
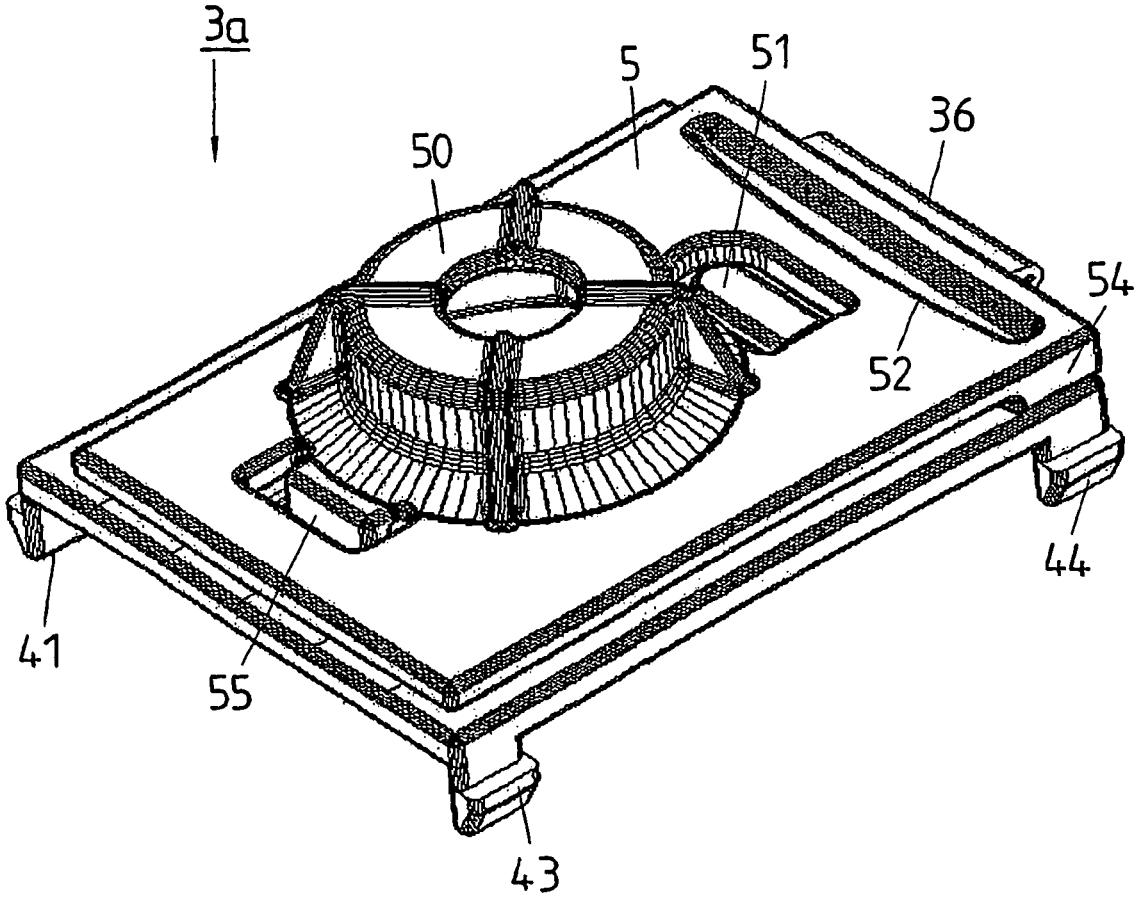
FIG. 5 is a perspective view of the guide part according to FIGS. 1 to 3 in the folded state and FIG. 6 is a perspective view of the guide part prefitted on the fixing region of a guide rail according to FIGS. 1 to 5.
Figure 6:
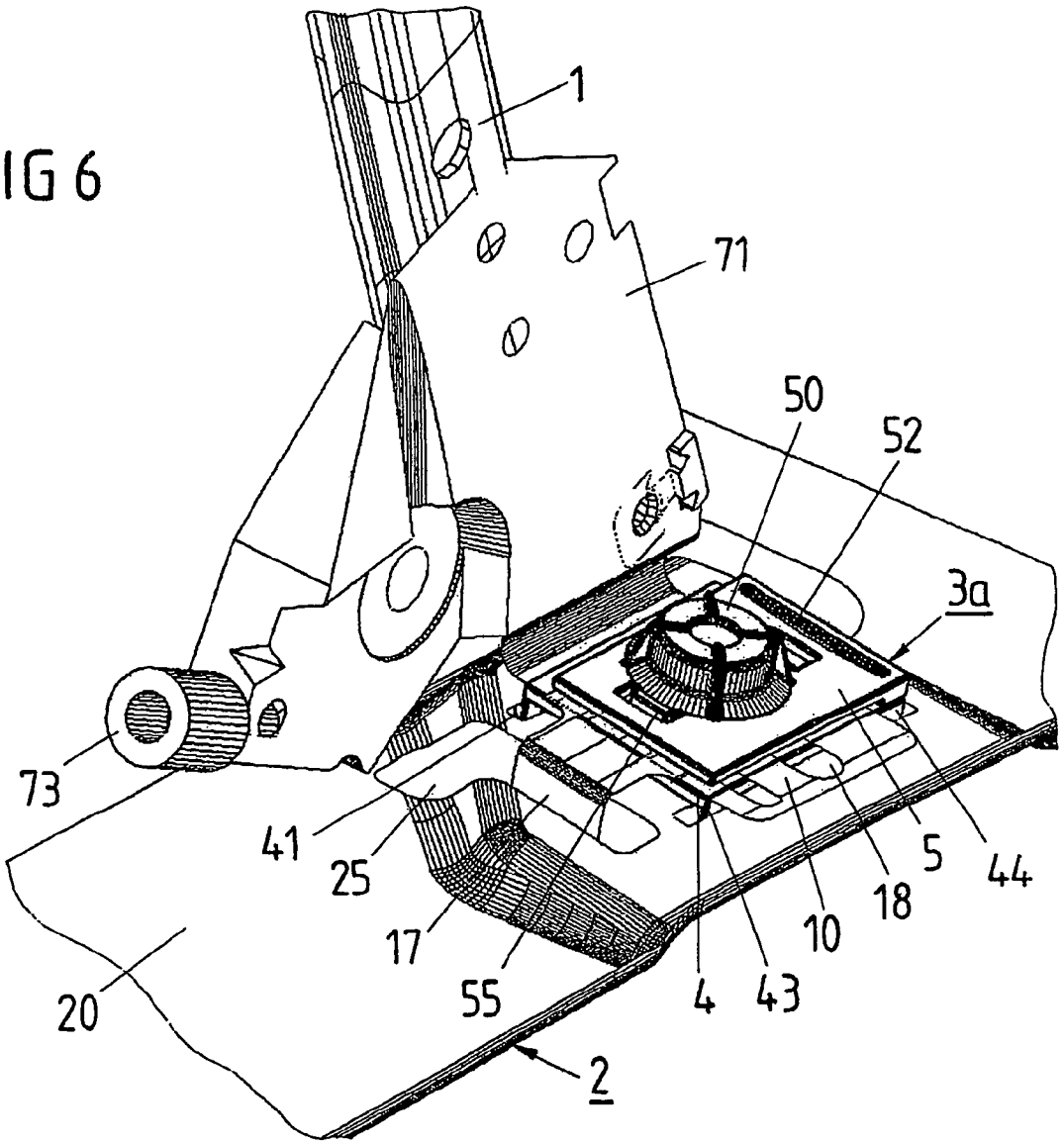

The connection between the fixing region 10 and the door body 20 is by means of the guide part 3*a* which is shown in perspective view in FIGS. 4 to 6 and which is assembled from a base plate 4 which is arranged in the fitted state between the fixing region 10 and the door body 20, and of a cover 5 which is connected to the base plate 4 and which bears with its inside face against the fixing region 10. The cover 5 of the guide part 3*a* has a screw head socket 50 which holds the fixing screw head 63 secured against loss and rotation through positive locking engagement.

The guide part 3*a* holds the fixing region 10 of the guide rail 1 between its base plate 4 and its cover 5 and is prefitted on the door body 20 through fixing clips 41 to 44. After the automatic alignment of the guide rail or after the additional manual alignment of the guide rail 1 by means of an adjusting lever 17 which is angled away from the fixing region 10 and which projects through an opening in the door body 20 where it can then be operated from outside of the door body 2, the final connection is made between the guide rail 1 and door body 2 through a fixing means 6 which is pushed through an oblong hole 18 in the fixing region 10, a corresponding opening in the guide part 3*a* and an opening in the door body 20.

The fixing means 6 consists according to FIG. 2 of a fixing screw 60 whose fixing screw head 63 is fixed secured against loss and rotation in the guide part 3*a* according to FIG. 4 and whose screw thread 64 is screwed to a fixing nut 61 which is fitted on from outside of the door body 20.

FIG. 1 shows that the guide part 3*a* is exposed to slight surface area pressure since the contact pressure force produced through the fixing means 6 is transferred through the fixing screw head 63 to the metal fixing region 10 of the guide rail 1, through the base plate 4 to the door body 20. It is thereby possible to make the guide part 3*a* which is composed of the cover 5 and base plate 4 from plastics in a single moulding process. Alternatively the cover 5 can form a continuous surface area on which the fixing screw head 63 of the fixing means 6 rests so that the fixing means 6 is incorporated fully into the guide part 3. In this embodiment is it advantageous if the contact area of the fixing screw head 63, where necessary also the entire cover 5, is provided with a glass fibre reinforcement.

FIG. 2 shows a longitudinal sectional view through the connecting region with a lower part of the guide rail 1 and its fixing region 10 connected to the door body 20 through the guide part 3*a* and shows the connection of the base plate 4 to the cover 5 of the guide part 3*a* through a positive locking element 56 as well as a closing clip 55 which engages through an opening in the fixing region 10 and locks with the base plate 5.

A detent element 51 which engages in a recess or opening 19 in the fixing region 10 of the guide rail 1 serves to preposition the guide part 3*a* on the fixing region 10 of the guide rail 1. The guide part 3*a* provides by means of the detent element 51 a standard position which serves for the preadjustment.

FIG. 3 shows a plan view of the connecting region with the fixing region 10 of the guide rail 1, the cover 5 of the guide part 3*a* as well as the openings or slots 21 to 25 provided in the door body 20 and shows the adjustability of the guide rail 1 in the Y direction through the arrangement of an oblong hole 18 in the fixing region 10 as well as an opening 25 in the door body through which the adjusting lever 17 is pushed. The fixing clips 41 to 44 which protrude from the outside of the base plate 4 of the guide part 3*a* are inserted into slots 21 to 24 in the door body 20 of which two slots, namely the slots 21, 22 are longer than the width of the associated fixing clips 21, 22 so that an X-compensation is possible. On the other hand the fixing clips 43, 44 are inserted into slots 23, 24 whose length corresponds to the width of the fixing clips 43, 44 so that these fixing clips 43, 44 are fixed in the X-direction.

Transfer of torque to the guide rail 1 during tightening of the fixing means 6 is prevented through the fixing clips 41 to 44 inserted in the slots 21 to 24 since the guide part 3*a* is pre-fixed on the door body 20 through the fixing clips 41 to 44 and torque occurring when securing the fixing means 6 is diverted into the door body 20.

The illustration of the fixing clips 41 to 44 and slots 21 to 24 according to FIG. 3 is easy to understand since either slots 21 to 24 are provided adapted to the width of the fixing clips 41 to 44 and thus enable no X-compensation or slots 21 to 24 are provided whose length is greater than the width of the associated fixing clips 21 to 24 so that X-compensation is possible. This means however that the insert part is suitable for the use of a guide rail in the region of the A-pillar and also a guide rail in the region of the B-pillar of a vehicle.

Through this type of connection of guide part 3*a* with the outer surface area 20 of the door body 2 it is ensured that the guide part 3*a* in the case of a double-strand cable window lifter with two guide rails can be used both for fixing the guide rail associated with the A-pillar and for fixing the guide rail associated with the B-pillar. The orientation of the fixing clips enables an X-compensation in the case of the guide rail which is associated with the A-pillar in that the associated slots are wider than the fixing clips. On the other hand through a width of the slot which is adapted to the width of the fixing clips a securing of the guide part is effected which serves to fix the guide rail which is associated with the B-pillar.

The X-compensation of the guide rail associated with the A-pillar is very important for a parallel lowering of the window pane guided over the guide rails so that sluggish action in the window lifter system is avoided. This X-compensation is then possible if the window pane is also moved downwards without the fixing means already being tightened and thus the relevant guide rail fixed on the door body. Thus the guide rail can automatically be positioned in the X and Y directions prior to actuating the fixing element whereby the fixing clips ensure that when tightening the fixing means after the automatic pre-positioning of the guide rail no torque is exerted on the guide rail with the resulting twisting of the guide rail.

A convex contact bearing face 52 provided on the cover 5 and illustrated by dotted lines adjoins one side edge of the fixing region 10 of the guide rail and by rotating the fixing region 10 around the Z axis enables automatic positioning of the fixing region 10 so that there is no twisting of the guide rail 1 during pre-fitting or tightening of the fixing means 6.

FIG. 4 shows in a perspective view a guide part 3*a* in the opened state and FIG. 5 shows the guide part 3*a* illustrated in FIG. 4 now in the folded state.

The base plate 4 and the cover 5 of the guide part 3*a* are connected together for swivel movement through a hinge designed as a film hinge 36. The four fixing clips 41 to 44 are arranged in the corner regions of the base plate 4 and can be pushed through the slots 21 to 25 in the door body 20 according to FIG. 3 to adjoin with their contact bearing edges in the fitted state against the outside of the door body 20. Furthermore the base plate 4 has a bore 40 through which the fixing means 6 are pushed. Further recesses in the form of oblong holes 45, 46 serve to hold a closing clip 55 and a positive locking element 56 in the cover 5.

The cover 5 has the closing clip 55 and the positive locking element 56 which is designed as a web and which is mounted on a raised surface 54 whose height corresponds roughly to the thickness of the fixing region 10 of the guide rail 1 arranged between the base plate 4 and cover 5. Furthermore the cover 5 contains a profiled screw head socket 50 which is adapted to a hexagonal screw head. The screw head socket 50 supports the part of the fixing means 6 designed as a fixing screw 60 secured against loss in the prefitted state and ensures an anti-rotational lock when screwing on a part of the fixing means 6 designed as a fixing nut 61.

Furthermore a detent element 51 is provided which consists of a ball head and a spring tongue so that it can engage with positive locking action in the corresponding counter detent element in the form of a recess or bore of the fixing region 10 of the guide rail 1 according to FIG. 2.

A convex stop 52 of the cover 5 formed on the raised surface 54 adjoins a side edge of the fixing region 10 of the guide rail 1 in the fitted state and enables a movement compensation of the fixing region 10 about the vehicle vertical axis (Z-axis) so that the guide rail 1 can automatically seek a suitable position without torque being exerted on same.

FIG. 5 shows in a perspective view the guide part 3*a* in the folded state of the base plate 4 and cover 5 and shows the detent connection between the two parts through the closing clip 55 and the alignment of the detent element 51 on the overlapping insides of the base plate 4 and cover 5 between which the fixing region 10 of the guide rail 1 is arranged. The guide part 3*a* which is preferably made from a mechanically strong plastics is thereby completely clamped.

FIG. 6 shows the prefitting of the guide part 3*a* on the fixing region 10 of a guide rail 1 in a perspective view.

A follower 71 is mounted longitudinally displaceable on the guide rail 1 and is connected to a drive means through a Bowden socket 73. The guide part 3*a* is together with the fixing screw 60 of the fixing means 6 held in the screw head socket 50 of the cover 5 clipped onto the fixing region 10 which is angled away from the guide rail 1 whereby the closing clip 55 secures the position of the guide part 3*a* on the fixing region 10 of the guide rail 1. This preassembled unit of guide rail 1 and fixing means of the guide rail 1, guide 3*a* and fixing means 6 is supplied as such to a final assembly site and is connected there to the door body 2 or door body 20 of a vehicle door.

The pre-positioning of the guide part 3*a* takes place according to FIG. 4 through the detent element 51 so that the guide part 3*a* is connected prepositioned with the fixing region 10 of the guide rail 1. By clipping the fixing clips 41 to 44, which protrude from the base plate 4 of the guide part 3*a*, into the slots 21 to 24 of the door body 20 according to FIG. 3 the connection is made between the assembly illustrated in FIG. 6 and the door body 2 whereby the adjusting lever 17 which is angled down to the door body 20 engages through the opening 25 in the door body according to FIG. 3.

Figure 7:
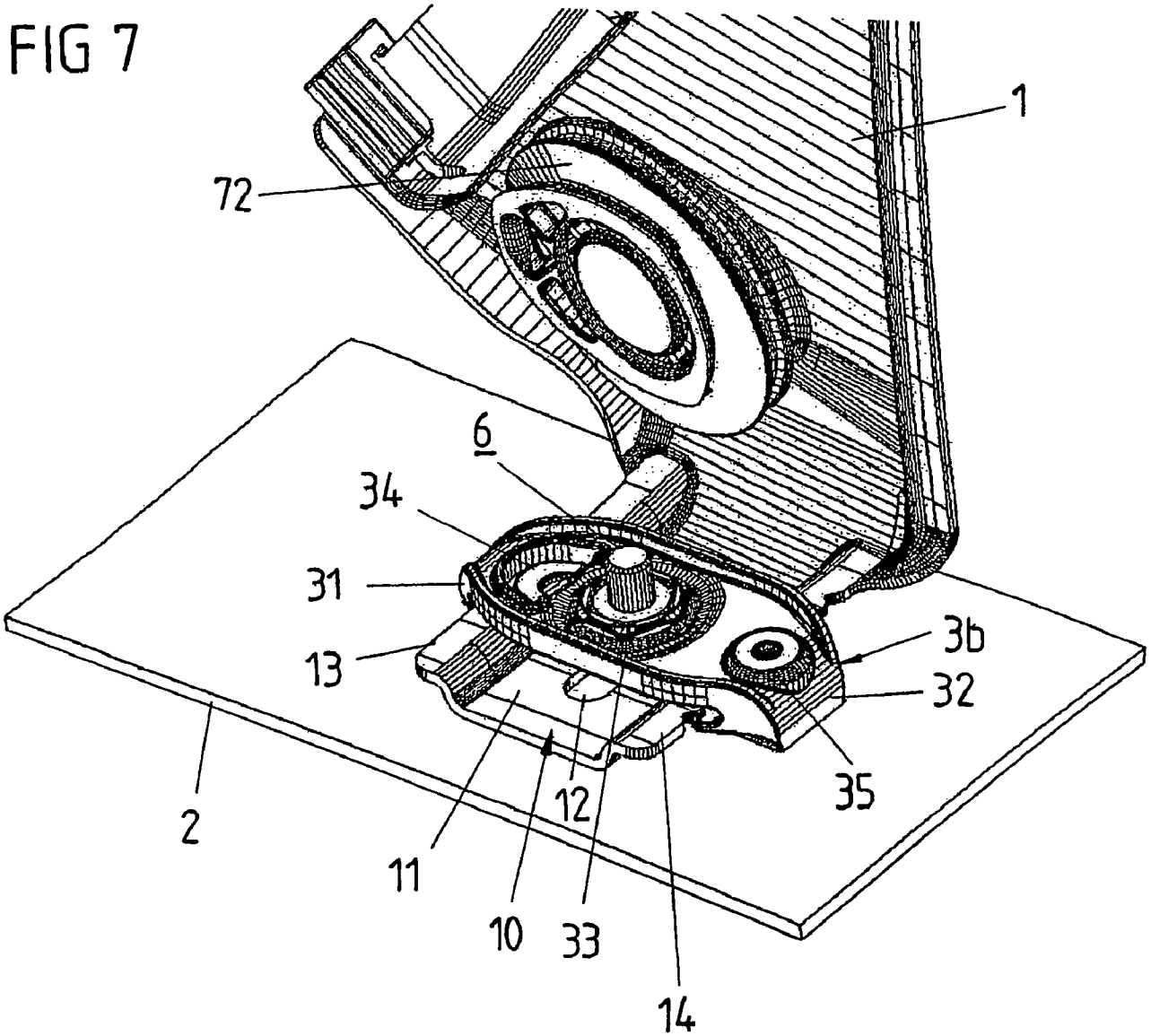
FIG. 7 is a perspective view of the fixing region of a guide rail, a part of a door body of a vehicle door and a guide part connected to the fixing region and door body in a second variation of the solution according to the invention.

A second variation of the solution according to the invention as shown in FIG. 7 shows in a perspective illustration a guide rail 1 with a guide pulley 72 arranged at the end of the area of movement of a window pane guided on the guide rail 1, and with a fixing region 10 which is angled relative to the guide region of the guide rail 1. The fixing region 10 lies with a contact bearing face 11 on the door base of a door body 2 and is connected with force locking engagement thereto through a fixing means 6 which consists of a fixing screw and fixing nut.

The fixing region 10 of the guide rail 1 is connected with positive engagement to a guide part 3*b* which prior to connecting the fixing region 10 to the door body 2 was prefitted on the fixing region 10 and which holds a part of the fixing means, for example the fixing nut, in a fixing means socket 33 secured in the circumferential and axial direction. The guide part 3*b* is formed in one piece and preferably consists of plastics which can be provided where applicable with a glass fibre reinforcement.

The guide part 3*b* engages with clip-type studs 31, 32 round edge zones 13, 14 which are angled from the bearing face 11 of the fixing region 10 and thus from the surface of the door base of the door body 2 and which run parallel to a slot opening 12 in the fixing region 10 of the guide rail 1.

Figure 13:
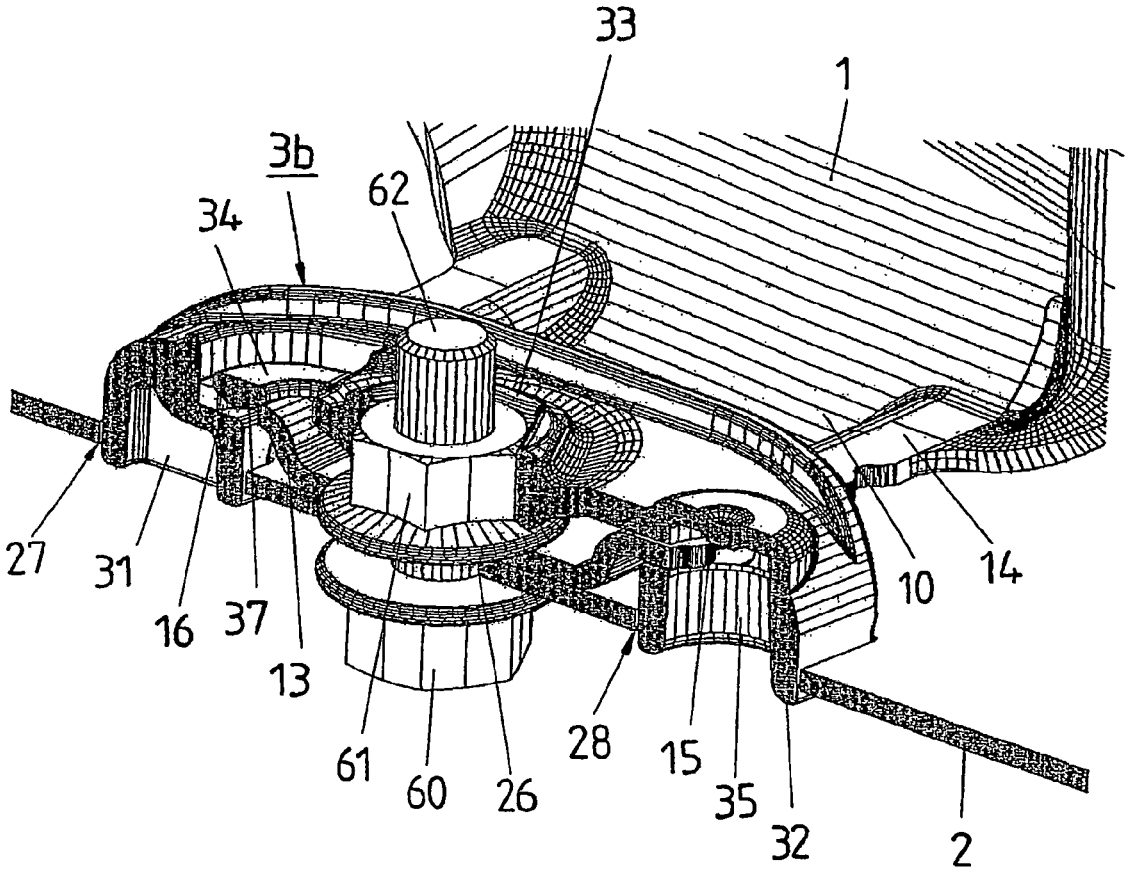
FIG. 13 is a longitudinal section through the fixing region of the guide rail, the door body, the guide part and the fixing means according to FIGS. 7 to 12.

The fixing means 6 which is formed for example as a screw connection from a fixing screw and a fixing nut is pushed through an opening in the door base of the door body 2 and the slot opening 12 and is connected to the part of the fixing means mounted in the fixing socket 33 so that the force-locking connection is made between the contact bearing face 11 of the fixing region 10 and the door body 2. Two further openings in the door body 2 serve to hold the ends of the clip-like studs 31, 32 of the guide part 3*b* which are extended towards the door body 2, and thus to take up fixing forces which are exerted by way of example in the form of screwing forces during connection of the fixing screw to the fixing nut of the fixing means 6. FIG. 13 shows further details for connecting the guide part 3*b* to the fixing region 10 of the guide rail 1 on one side and to the door body 2 on the other.

Figure 8:
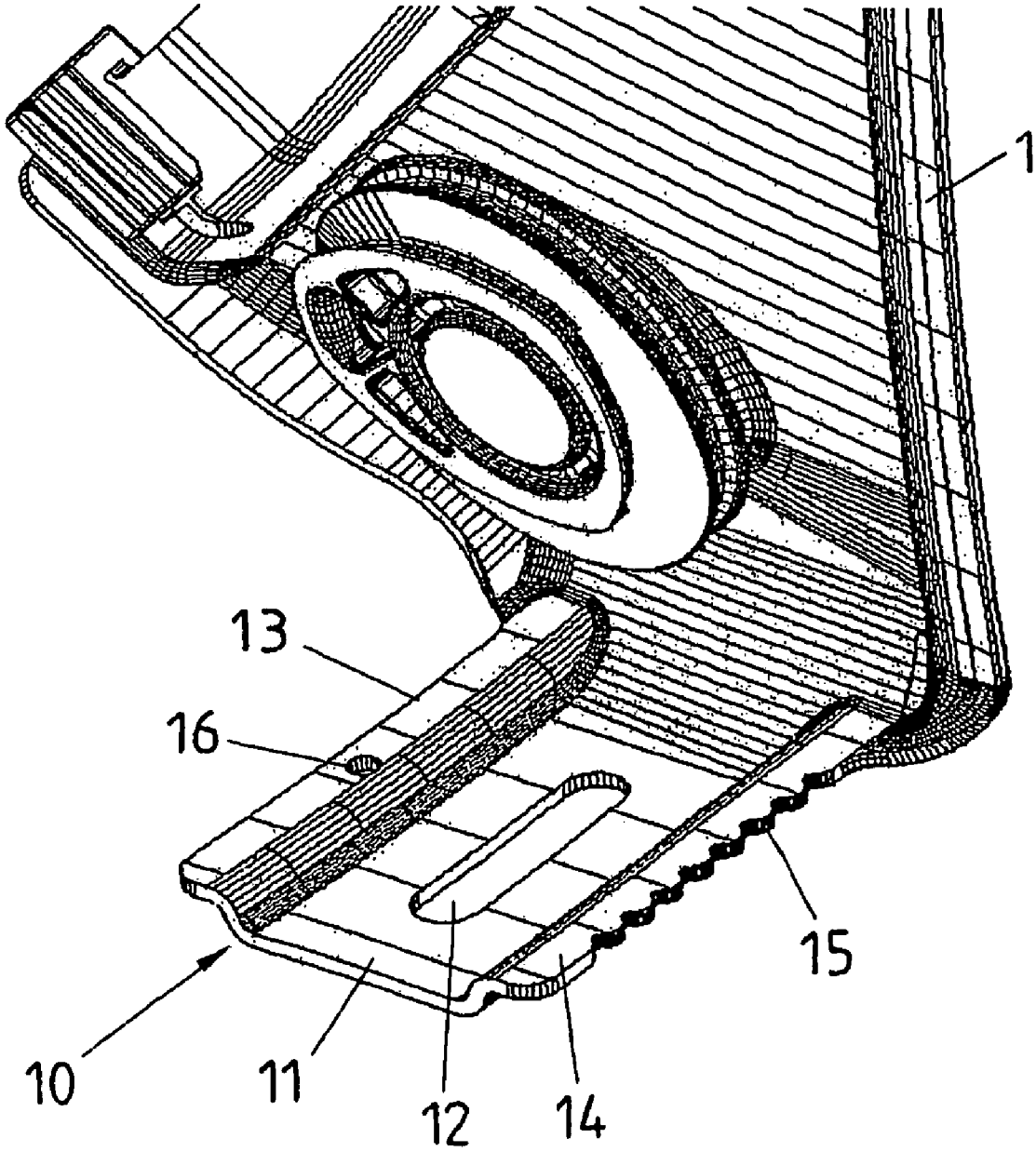
FIG. 8 is a perspective view of the guide rail and the fixing region of the guide rail according to FIG. 7 with slot opening inside the fixing region.

FIG. 8 likewise shows in a perspective view the guide rail 1 with the fixing region 10 angled from the guide region of the guide rail 1 and comprised of the contact bearing face 11 and the side angled edge zones 13, 14. A slot opening 12 which runs in the transverse direction of the vehicle or Y-direction is provided in the contact bearing surface 11 and enables an adjustment of the guide rail 1 in relation to the door body 2 according to FIG. 7 in the transverse direction of the vehicle and thus a tension-free assembly of the guide rail 1. The one angled edge zone 13 has a recess or detent opening 16 which enables the positioning of the guide part 3*b* according to FIG. 7 in a nominal position in connection with a detent element of the guide part 3*b*.

The other angled edge zone 14 is provided with an undulating toothed region 15 in which the toothed region of a tool (illustrated in FIGS. 14 and 15) engages for the fine adjustment of the guide rail 1 in the Y-direction of the vehicle.

Figure 9:
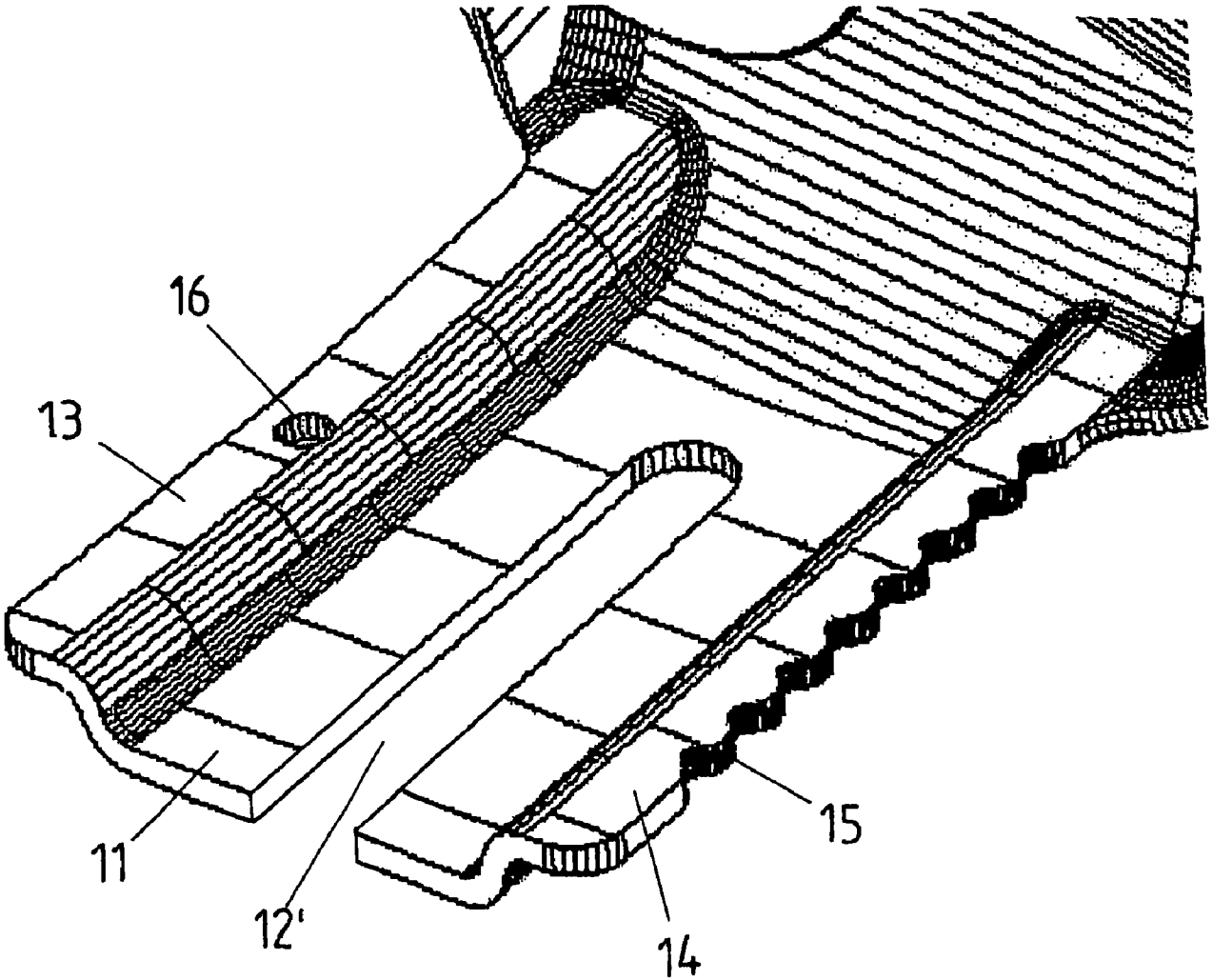
FIG. 9 is a perspective view of a variation of the fixing region according to FIG. 7 with slot opening passing through to the edge of the fixing region.

FIG. 9 shows a variation of the fixing region 10 with a slot opening 12' which is guided up to the edge of the bearing face 11. Whereas with the embodiment according to FIG. 8 in the fixing socket 33 of the guide part 3*b* according to FIG. 7 there is a fixing nut secured in the axial direction and in the circumferential direction and thus secured against loss and the connection is made between the fixing region 10 of the guide rail 1 and the door body 2 through a fixing screw which is pushed through an opening provided in the door base of the door body 2 and through the slot opening 12 according to FIG. 8, in the embodiment according to FIG. 9 the fixing screw is held secured against loss in the fixing socket 33 of the guide part 3*b* and the force locking connection is made between the fixing region 10 of the guide rail 1 and the door body 2 by screwing a fixing nut onto the fixing screw which is pushed through the full-length slot opening 12' and the opening in the door body 2.

FIG. 9 shows on an enlarged scale the detent opening 16 provided in the one angled edge zone 13 of the fixing region 10 for the nominal positioning of the guide part and the undulating toothed region 15 provided in the other angled edge zone 14 for the fine adjustment of the fixing region 10 of the guide rail 1 and thus of the draw-down line of the guide rail in the Y-direction of the vehicle.

Figure 10:
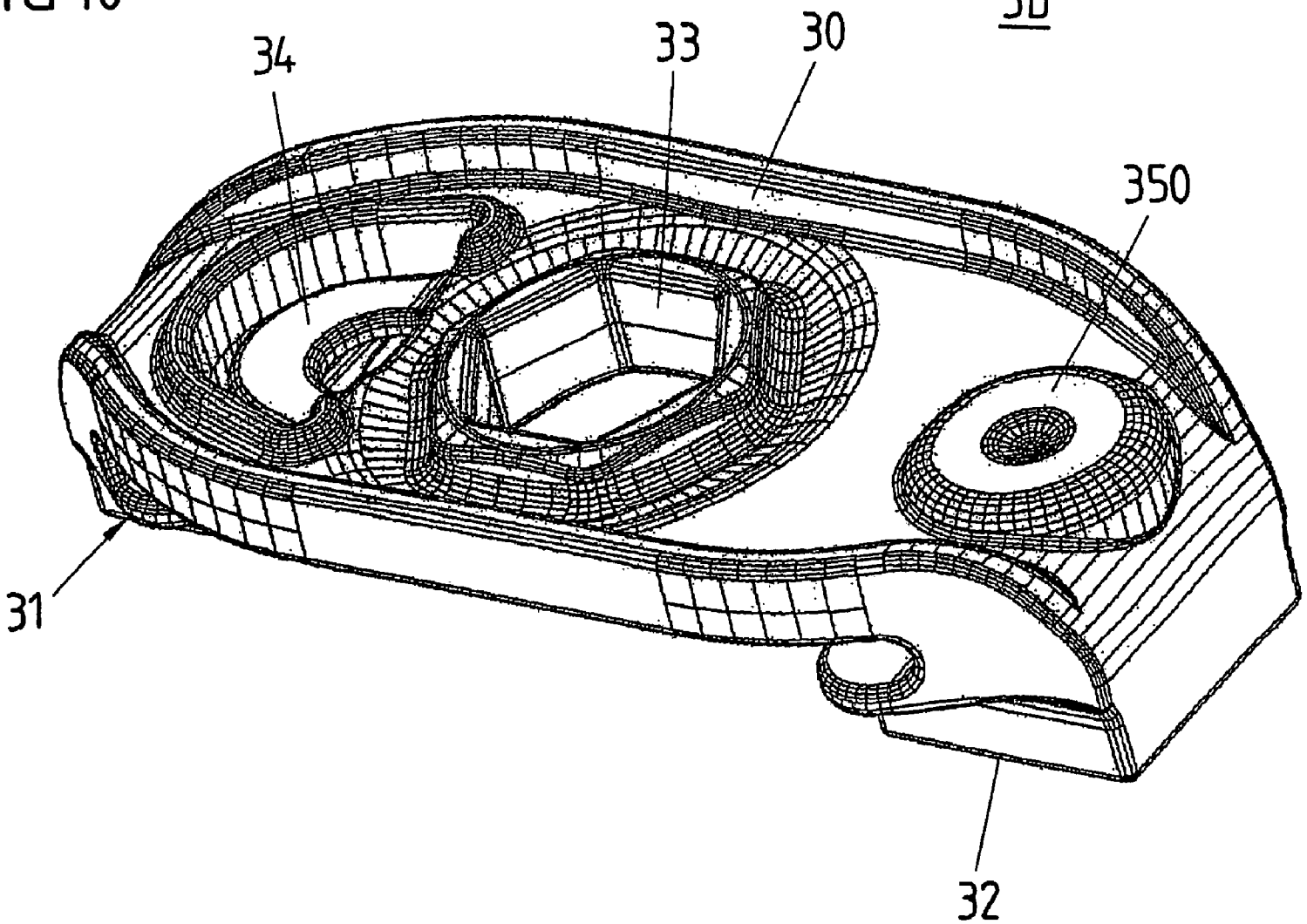
FIG. 10 is a perspective view of the guide part according to FIG. 7.

FIG. 10 shows in an enlarged perspective individual view the guide part 3*b* whose base body 30 is aligned transversely to the longitudinal extension of the fixing region 10 of the guide rail 1 and has at its side ends clip-type studs 31, 32 which on the one hand engage round the angled edge zones 13, 14 of the fixing region 10 of the guide rail 1 and on the other can be inserted as anti-rotation locking studs in positioning openings in the door body 2. The base body 30 has roughly in the middle a fixing means socket 33 which in this embodiment is designed as a hexagonal opening for holding a fixing nut or screw head of a fixing screw.

Figure 14:
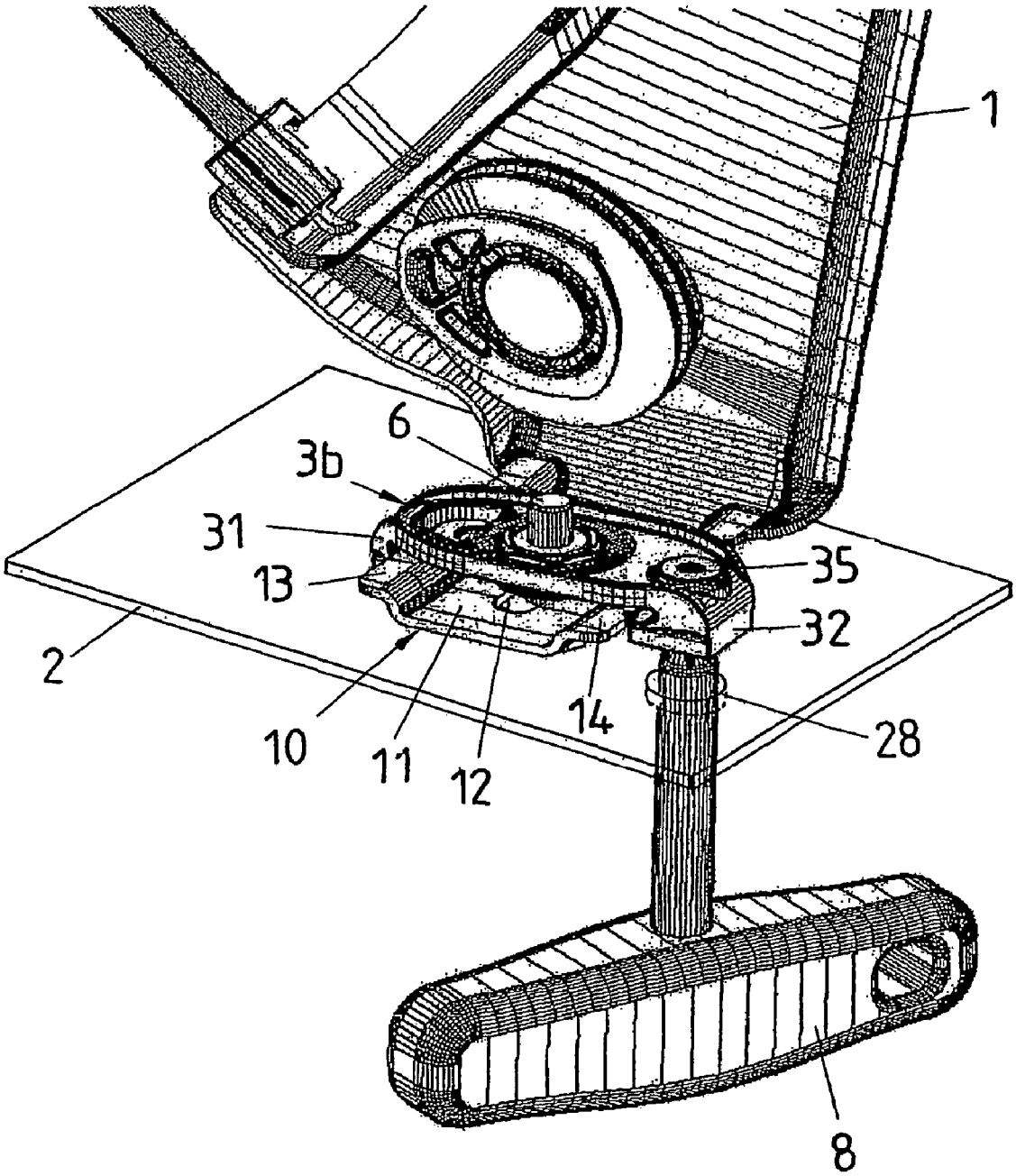
FIG. 14 is a perspective view of the adjustment of a guide rail by means of a Torx screw driver and FIG. 15 is a perspective view as in FIG. 14 from the underneath of the fixing region of the guide rail.
Figure 15:
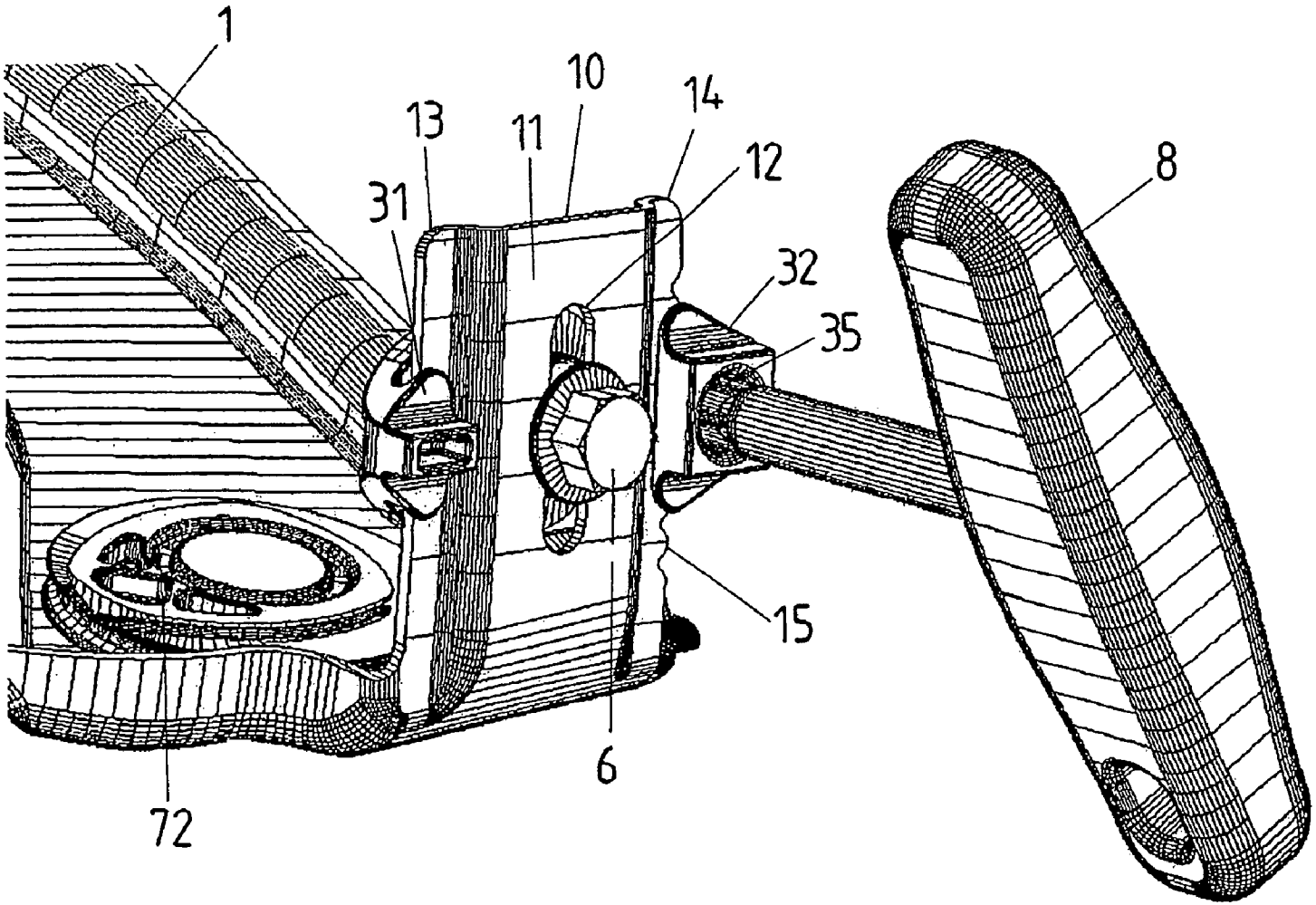

At the side of the fixing means socket 33 there is on the one side a clip 34 for holding a detent connection with the fixing region 10 of the guide rail 1 for the secured preassembly of the guide part 3*b* on the fixing region 10 of the guide rail 1 and for the alignment of the guide part 3*b* in a nominal position on the fixing region 10 of the guide rail 1, and on the other side the base of a pot-shaped opening 35 open to the door body for guiding the tool illustrated in FIGS. 14 and 15. The stud 32 forms a bearing region 350 of the pot-shaped opening 35 for supporting the tool guided in the pot-shaped opening 35 according to FIGS. 14 and 15.

Figure 11:
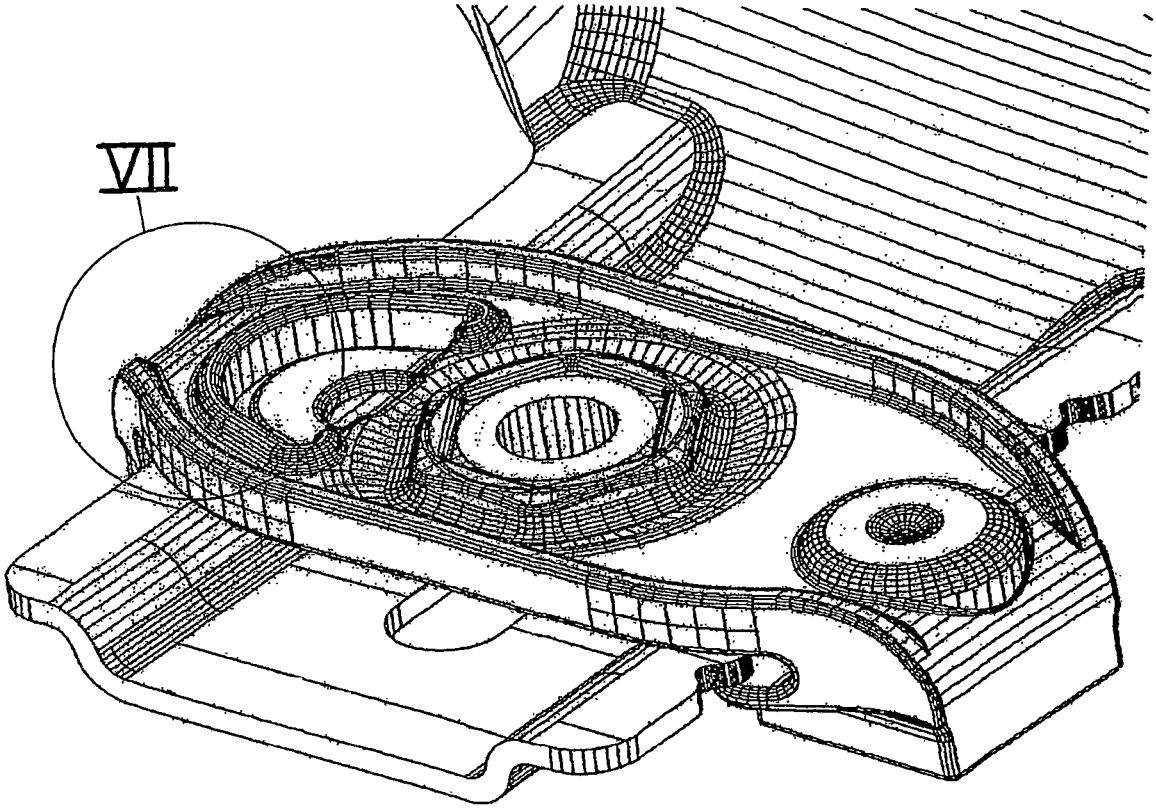
FIG. 11 is a perspective view of the guide part prefitted on the fixing region of a guide rail according to FIG. 10.

FIG. 11 shows in a perspective view the guide part 3*b* which is pre-fitted on the fixing region 10 of the guide rail 1 and which in this pre-fitted position is connected secured against loss to the fixing region 10 of the guide rail 1 through the detent connection.

Figure 12:
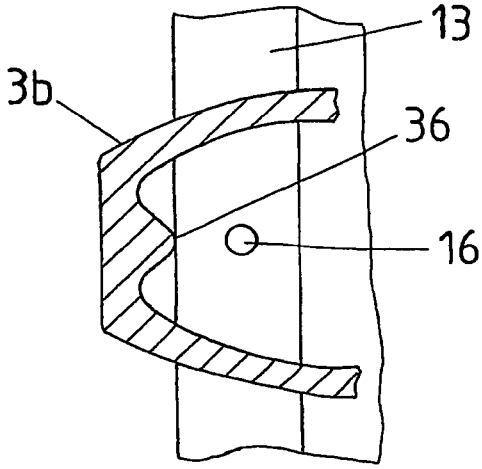
FIG. 12 is a section through the cut-out section X11 according to FIG. 11.

FIG. 12 shows a section through the partial region XII according to FIG. 11.

The side wall of the guide part 3*b* has in the partial region XII a bearing bead 36 which adjoins the outside edge of the angled edge region 13 of the fixing region 10 of the guide rail 1 and thus permits tilting movements of the fixing region 10 of the guide rail 1. Thus on the one hand the engagement of the toothed region of the tool in the undulating toothed region 15 of the angled edge zone 14 of the fixing region 10 of the guide rail 1 is ensured and on the other the easy swivel action of the fixing region 10 of the guide rail 1 inside the guide part 3*b* is guaranteed.

Furthermore FIG. 12 shows the detent opening 16 for holding the detent catch of the detent connection illustrated in FIG. 13 between the guide part 3*b* and the fixing region 10 in the nominal position.

FIG. 13 shows in a sectional perspective illustration the connection of the individual parts described above in the assembled state.

The guide part 3*b* which is prefitted on the fixing region 10 of the guide rail 1 is connected to the door base of the door body 2 through its studs 31, 32 which are inserted into the positioning openings 27, 28 of the door body 2. Through the fixing means opening 26 of the door body 2 is pushed the fixing screw shaft 62 of a fixing screw 60 which is screwed with a fixing nut 61 which is held in the fixing means socket 33 secured in the rotational direction and in the axial direction.

The stud 32 has the pot shaped opening 35 which is open towards the door body 2 to receive the tool (illustrated in FIGS. 14 and 15) which engages by its toothed region into the undulating toothed region 15 of the angled edge zone 14 of the fixing region 10. In the opposite angled edge zone 13 is provided the detent opening 16 to hold a detent catch 37 which is designed as part of a clip 34 and which on engagement in the detent opening 16 secures the nominal position of the guide part 3*b* in relation to the fixing region 10 of the guide rail 1. The detent catch 37 is formed as a plastics head which in the nominal position of the guide part 3*b* engages in the detent opening 16 in the angled edge zone 13 of the fixing region 10. This detent connection can be released for adjusting the guide rail 1 in the Y-direction and can be engaged again for pre-fitting the guide part 3*b* secured against loss on the connecting region 10.

As can be seen from the perspective view according to FIG. 13, the studs 31, 32 of the guide part 3*b* transfer the screwing forces which arise when screwing on the fixing screw 60 and fixing nut 61 directly to the door body 2 so that the screwing forces are not guided through the fixing region 10 of the guide rail 1 but are diverted directly into the vehicle door. The studs 31, 32 thus serve to secure the guide rail 1 against rotation during their force locking connection with the door body 2 of the vehicle door.

Furthermore the positioning openings 27, 28 in the door body 2 in conjunction with the studs 31, 32 serve to preposition and pre-fix the guide part 3*b* on the door body 2 of the vehicle door.

FIGS. 14 and 15 show in a perspective view from different aspects the connecting device during the adjustment of the guide rail 1 in the Y-direction of the vehicle by means of a tool 8.

FIGS. 14 and 15 show the tool 8 pushed through the opening 22 in the door base of the door body 2 in the form of a Torx screw driver which is guided in the pot-shaped opening 35 provided in the stud 32 of the guide part 3*b* and which engages in the undulating toothed region 15 of the angled edge zone 14 of the fixing region 10. By turning the tool 8 in one or other direction of rotation the fixing region 10 is guided through the slot opening 12 in one or other direction in the Y-direction of the vehicle and the guide rail 1 is thus aligned in relation to the door body 2. After aligning the guide rail 1 the fixing means 6 is tightened and thus a force locking connection is produced between the bearing face 11 of the fixing region 10 and the door body 2. The studs 31, 32 which are inserted into the positioning openings 27, 28 of the door body 2 thereby divert the screwing forces directly into the door body 2 so that no rotation of the fixing region 10 can be caused by the screwing forces through the guide part 3*b*.

FIG. 15 shows in a perspective view from below the connection the holding of the tool 8 in the pot-shaped opening 35 of the stud 32 which like the opposite stud 31 of the guide part 3*b* engages round the angled edge zone 13, 14 of the fixing region 10 of the guide rail 1.

When connecting the two guide rails of a double-strand cable window lifter the one guide rail as already described with reference to FIGS. 1 to 9 is connected to the door body 2 whilst the other guide rail for automatic compensation in the direction of the vehicle longitudinal axis or X-direction is connected to a guide part which is prefitted on the fixing region of this guide rail and which engages in the moulded holes of the door body 2 which are formed as oblong holes in the X-direction so that the studs of the guide part can execute a movement compensation in the X-direction. In the same way the slot opening 12 in the fixing region of this guide rail is wider than the fixing screw shaft so that the fixing region can also execute a compensation movement in the X-direction.

By inserting the guide parts which are prefitted on the fixing regions of the two guide rails into the moulded holes or moulded holes extended in the X-direction of the door body, the tolerances are automatically compensated in the X-direction whilst the fine adjustment in the Y-direction is carried out in the manner described above by means of a tool 8.

The guide part 3*b* can therefore be used both for a guide rail mounted on the A-pillar and also for a guide rail mounted on the B-pillar. The orientation of the clip-like studs 31, 32 of the guide part 3*b* enables an X-compensation with for example the guide rail associated with the A-pillar when the positioning openings 27, 28 in the door body 2 in the X-direction are wider than the clip-shaped studs 31, 32 of the guide part 3*b*. This X-compensation is very important and leads to an exact parallel alignment of the two guide rails of a double-strand cable window lifter so that sluggish action is prevented in any window lifter system. The X-compensation is then possible if the window pane is moved downwards without the fixing means on the guide rail associated with the A- pillar having produced a fixed connection between the fixing region of the guide rail and the door body of the vehicle door. The guide rail is thus automatically positioned in the X and Y directions of the vehicle.

The invention claimed is:

1. A device for connecting a fixing region of a guide rail to a door body of a vehicle door, the door body having an outer surface area and an opening through the outer surface area through which a multi-part fixing device can be fitted, comprising:

a guide part which is prefitted on the fixing region of the guide rail and is connectable to the door body and which receives a first part of the multi-part fixing device, further comprising a device for aligning the fixing region of the guide rail to the guide part and to the door body at least in the direction of the vehicle transverse axis (Y-axis) and a second part of the fixing device to produce a clamping connection between the fixing region of the guide rail and the door body;

wherein a part of the fixing device is located through a slot opening running in the direction of the vehicle transverse axis (Y-axis) in the fixing region of the guide rail;

wherein the fixing region of the guide rail has a contact bearing face and edge zones angled from the contact bearing face and running parallel to the slot opening, and that the guide part engages round the edge zones, wherein the guide part includes studs that are insertable with positive locking connection into positioning openings of the door body; and further comprising a detent connection which engages in a nominal position of the guide part relative to the fixing region of the guide rail, the detent connection comprising an opening provided in a first angled edge zone of the angled edge zones of the fixing region of the guide rail and a detent catch of the guide part engaging in the opening and having a ball head which engages in the opening of the fixing region of the guide rail.

2. The device according to claim 1, wherein the guide part is formed in one piece and the guide part is connected displaceable and with positive locking engagement to the fixing region of the guide rail on the side of the fixing region remote from the door body.

3. The device according to claim 1, wherein to connect a double strand cable window lifter to the door body of a vehicle door the slot opening in the fixing region of a guide rail is wider than the part of the fixing device pushed through the slot opening and the studs of the guide part associated with the fixing region of the guide rail engage with play in a direction of the vehicle longitudinal axis (X-direction).

4. The device according to claim 1, wherein the first angled edge zone of the fixing region of the guide rail has positive locking elements with which counter positive locking elements of a tool, which is insertable into a pot shaped tool socket of one stud of the guide part open to the door body, is brought into engagement, and that in a second stud of the guide part there is a bearing bead which bears against an outer edge of a second angled edge zone of the fixing region of the guide rail engaged by the stud.

5. The device according to claim 1, wherein the detent catch or ball head is releasable from the opening of the fixing region of the guide rail.

6. The device according to claim 1, wherein the fixing device comprises a connection of a fixing screw with a fixing nut and wherein the guide part holds the fixing screw or fixing nut of the fixing device in a fixing means socket which secures the fixing screw or fixing nut in an axial direction of the fixing screw and in a rotational direction.

* * * * *